US010935287B2

(12) United States Patent
Choi

(10) Patent No.: US 10,935,287 B2
(45) Date of Patent: Mar. 2, 2021

(54) HEAT PUMP SYSTEM

(71) Applicants: Hyundai Motor Company, Seoul (KR); KIA Motors Corporation, Seoul (KR)

(72) Inventor: Hoon Choi, Uiwang-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 61 days.

(21) Appl. No.: 16/387,037

(22) Filed: Apr. 17, 2019

(65) Prior Publication Data

US 2020/0149790 A1 May 14, 2020

(30) Foreign Application Priority Data

Nov. 9, 2018 (KR) ..... 10-2018-0137592

(51) Int. Cl.
*F25B 30/06* (2006.01)

(52) U.S. Cl.
CPC ..... *F25B 30/06* (2013.01); *F25B 2313/021* (2013.01); *F25B 2400/24* (2013.01)

(58) Field of Classification Search
CPC .. F25B 30/06; F25B 2313/021; F25B 29/003; F25B 2400/24; F25B 11/02; F25B 2339/047; F25B 9/002; F25B 25/005; F01K 1/00
See application file for complete search history.

(56) References Cited

U.S. PATENT DOCUMENTS 6,370,903 B1 * 4/2002 Wlech ..... B60H 1/32281 62/324.6
7,940,028 B1 * 5/2011 Hermann ..... H01M 10/443 320/151
2003/0029649 A1 * 2/2003 Baumert ..... H01M 8/04029 180/54.1
2004/0020206 A1 * 2/2004 Sullivan ..... F01K 23/101 60/670
2009/0130513 A1 * 5/2009 Tsuchiya ..... B60L 58/34 429/412
2014/0223933 A1 * 8/2014 Steele ..... F25B 27/02 62/98
2016/0169079 A1 * 6/2016 Zhou ..... B60H 1/00007 60/670
2017/0197490 A1 * 7/2017 Enomoto ..... B60H 1/00899
2018/0361828 A1 * 12/2018 Kato ..... F25B 25/005
2019/0030989 A1 * 1/2019 Miura ..... F25B 5/04
(Continued)

FOREIGN PATENT DOCUMENTS

KR 10-1027134 4/2011

*Primary Examiner* — Kun Kai Ma
(74) *Attorney, Agent, or Firm* — Brinks Gilson & Lione

(57) ABSTRACT

The present disclosure relates to a heat pump system. The heat pump system removes heat generated during the generation of electric energy using a power generator and also performs heating using waste heat. Since an additional heat source is created in order to meet a heating requirement, heating control is effectively achieved, and electric power is produced so as to meet the demand of electric energy. When the power generator is likely to be over-cooled in the cold season, cooling of the power generator is stably performed by controlling the temperature and the flow rate of a cooling medium moving to the power generator.

11 Claims, 7 Drawing Sheets

(56) References Cited

U.S. PATENT DOCUMENTS

| | | | | |
|---|---|---|---|---|
| 2019/0030991 | A1* | 1/2019 | Enomoto | B60H 1/00885 |
| 2020/0047586 | A1* | 2/2020 | Gonze | B60H 1/00278 |
| 2020/0164719 | A1* | 5/2020 | Shiratori | F25B 1/00 |
| 2020/0166248 | A1* | 5/2020 | Kato | B60H 1/32 |
| 2020/0198443 | A1* | 6/2020 | Kato | F25B 29/00 |

* cited by examiner

HEAT PUMP SYSTEM

CROSS-REFERENCE TO RELATED APPLICATION

This application claims priority to and the benefit of Korean Patent Application No. 10-2018-0137592, filed on Nov. 9, 2018, which is incorporated herein by reference in its entirety.

FIELD

The present disclosure relates to a heat pump system that removes heat generated during the generation of electric energy and also performs heating using waste heat.

BACKGROUND

The statements in this section merely provide background information related to the present disclosure and may not constitute prior art.

In general, a heat pump system includes a compressor, a condenser, an evaporator, and an expansion valve. Such a heat pump system absorbs or emits heat by circulating a heating medium therethrough, thereby performing a cooling/heating function, a cold/hot water supply function, and a hot water supply function of instantaneously generating hot water.

The conventional heat pump system performs temperature control by using thermal energy generated from a condenser. However, we have discovered that it is difficult to meet a heating requirement by using only the thermal energy generated from the condenser. In order to supplement this energy, therefore, a separate auxiliary heating device such as an electric heater or a burner needs to be added. However, the addition of the auxiliary heating device leads to an increase in the number of components, a complicated structure, and the requirement to individually operate and control the respective components.

The above information disclosed in this Background section is only for enhancement of understanding of the general background of the present disclosure, and therefore it may contain information that does not form the prior art that is already known to a person of ordinary skill in the art.

SUMMARY

The present disclosure provides to a heat pump system that removes heat generated during the generation of electric energy and also performs heating using waste heat.

In accordance with a form of the present disclosure, a heat pump system includes a cooling cycle configured to circulate a cooling medium therethrough. The cooling cycle includes a cooling pump, a power generator, and an evaporator, and the power generator and the evaporator is connected to each other so as to perform heat exchange to cause the cooling medium cooled by the evaporator to cool the power generator. The heat pump system further includes a first cycle configured to circulate a first heating medium therethrough. The first cycle includes a compressor, a heat exchanger connected to the evaporator of the cooling cycle so as to perform heat exchange, a first supply path provided between the evaporator and the compressor to supply a heat source created by the first heating medium, and a first valve configured to selectively allow supply of the first heating medium to the first supply path. In addition, the heat pump system includes a second cycle configured to circulate a second heating medium, exchanging heat with the first heating medium through the heat exchanger, therethrough. The second cycle includes a second supply path configured to supply a heat source created by the second heating medium, having increased in temperature through the heat exchanger, and a second valve configured to selectively allow supply of the second heating medium to the second supply path. The heat pump system also includes a controller configured to control the opening and closing of the first valve and the second valve. In addition, when the controller performs control to open the first valve, the heat source created by the first heating medium is supplied, and when the controller performs control to open the second valve, the heat source created by the second heating medium, having a relatively high temperature, is supplied.

According to a further aspect of the present disclosure, the first cycle may share the evaporator with the cooling cycle and may further include a first expander. The first heating medium, having increased in temperature due to heat exchange with the cooling medium through the evaporator, may move to the compressor or to the first supply path depending on opening or closing of the first valve.

The first expander may be a turbine configured to generate electric energy during the circulation of the first heating medium.

According to a further aspect of the present disclosure, the second cycle may share the heat exchanger with the first cycle and may further include a second expander, a condenser, and a heat source pump. The second heating medium, having increased in temperature due to heat exchange with the first heating medium through the heat exchanger, may move to the second expander or to the second supply path depending on opening or closing of the second valve.

The second expander may be a turbine configured to generate electric energy during the circulation of the second heating medium.

When additional electricity generation is demanded, the controller may perform control to close the second valve and to increase the operation degree of the heat source pump.

According to a further aspect of the present disclosure, when supply of the heat source created by the first heating medium is demanded, the controller may perform control to open the first valve, to close the second valve, and to reduce the operation degree of the compressor.

According to a further aspect of the present disclosure, when supply of the heat source created by the second heating medium is demanded, the controller may perform control to close the first valve, to open the second valve, and to increase the operation degree of the compressor.

According to a further aspect of the present disclosure, the cooling cycle may further include a cooling device configured to cool the cooling medium, and the cooling device may be located in the path along which the cooling medium moves from the evaporator to the power generator.

The cooling cycle may further include a bypass path along which the cooling medium, moving from the evaporator to the power generator, bypasses the cooling device, and a bypass valve configured to switch the path along which the cooling medium circulates.

When additional cooling of the power generator is demanded, the controller may perform control to close the bypass valve and to increase the operation degree of the cooling pump.

The controller may determine whether the power generator is in an over-cooled state. Upon determining that the power generator is in an over-cooled state, the controller may control the bypass valve to be opened to inhibit the cooling medium from moving to the cooling device.

Further areas of applicability will become apparent from the description provided herein. It should be understood that the description and specific examples are intended for purposes of illustration only and are not intended to limit the scope of the present disclosure.

DRAWINGS

In order that the disclosure may be will understood, there will now be described various forms thereof, given by way of example, reference being made to the accompanying drawings, in which.

Figure 1:
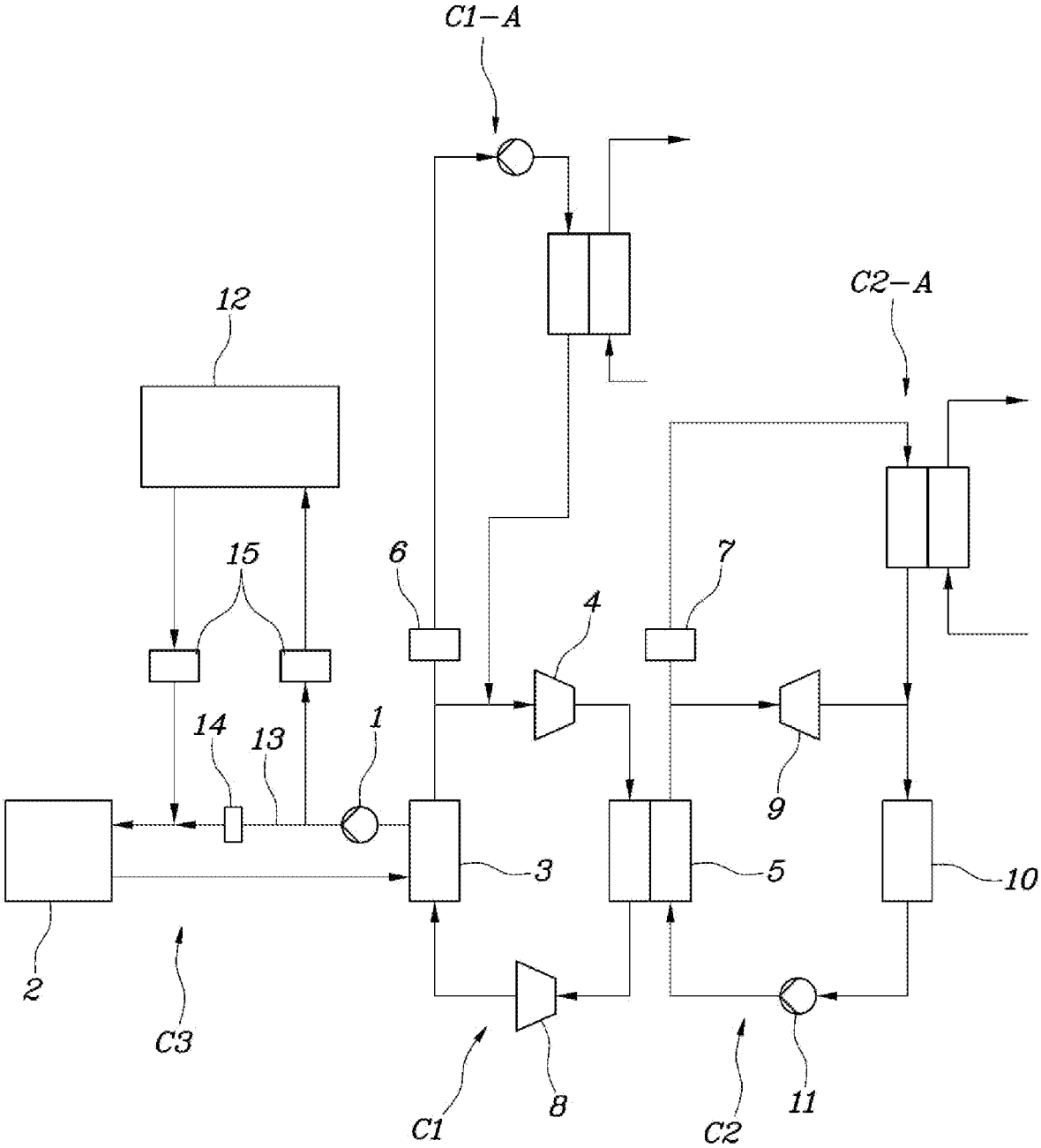
FIG. 1 is a schematic diagram showing a heat pump system according to an exemplary form of the present disclosure.

The drawing described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 is a schematic diagram showing a heat pump system according to an exemplary form of the present disclosure. FIGS. 2 through 6 are schematic diagrams showing the operation of the heat pump system shown in FIG. 1. FIG. 7 is a block diagram showing the construction of the heat pump system shown in FIG. 1.

A heat pump system according to the present disclosure, as shown in FIG. 1, includes a cooling cycle C3, which is provided therein with a cooling pump 1 to circulate a cooling medium therethrough and in which a power generator 2 and an evaporator 3 are connected to each other so as to perform heat exchange, the cooling medium cooled by the evaporator 3 cooling the power generator 2, a first cycle C1, which is provided therein with a compressor 4 to circulate a first heating medium therethrough, in which the evaporator 3 of the cooling cycle C3 and a heat exchanger 5 are connected to each other so as to perform heat exchange, in which a first supply path C1-A, configured to supply a heat source created by the first heating medium, is provided between the evaporator 3 and the compressor 4, and in which a first valve 6, configured to selectively allow the supply of the first heating medium to the first supply path C1-A, is provided, a second cycle C2, through which a second heating medium, exchanging heat with the first heating medium through the heat exchanger 5, circulates, in which a second supply path C2-A, configured to supply a heat source (a second heat source) created by the second heating medium, having increased in temperature through the heat exchanger 5, is provided, and in which a second valve 7, configured to selectively allow the supply of the second heating medium to the second supply path C2-A, is provided, and a controller 100, configured to control the opening and closing of the first valve 6 and the second valve 7. When the controller 100 performs control to open the first valve 6, the heat source created by the first heating medium is supplied, and when the controller 100 performs control to open the second valve 7, the heat source created by the second heating medium, having a relatively high temperature, is supplied.

As shown in FIG. 1, the power generator 2 may be a fuel cell using hydrogen. According to other forms of the present disclosure, the power generator 2 may be any one of various other electricity generation devices. When the power generator 2 generates electric energy, heat is emitted due to the characteristics of the power generator 2. Therefore, the cooling cycle C3 is provided to remove the heat emitted from the power generator 2. The power generator 2 is cooled by the cooling medium circulating through the cooling cycle C3. The first cycle C1 is connected to the cooling cycle C3 in order to adjust the temperature of the cooling medium.

The first heating medium circulates through the first cycle C1 and exchanges heat with the cooling medium through the evaporator 3. As the cooling medium, having increased in temperature after cooling the power generator 2, exchanges heat with the first heating medium through the evaporator 3, the temperature of the cooling medium is reduced and the temperature of the first heating medium is increased. The heat exchange between the cooling medium and the first heating medium through the evaporator 3 may be realized through a commonly used heat exchange structure, in which different flow passages are in contact with each other so as to exchange heat therebetween. Therefore, a detailed description of the heat exchange structure of the evaporator 3 will be omitted.

The cooling medium, having decreased in temperature due to heat exchange with the first heat medium through the evaporator 3, moves to the power generator 2 and cools the same. Depending on opening or closing of the first valve 6, the first heating medium, having increased in temperature, may move to a place that needs a heat source via the first supply path C1-A, or may circulate through the first cycle C1. Here, the place that needs a heat source may be a heating facility of a building, a heating device of a vehicle, etc.

The first cycle C1 is connected with the second cycle C2 in order to adjust the temperature of the first heating medium and to provide a high-temperature heat source. The second heating medium circulates through the second cycle C2 and exchanges heat with the first heating medium through the heat exchanger 5. The first cycle C1 is provided with the compressor 4 for circulation of the first heating medium. Since the first heating medium, having been heated to a high temperature by the compressor 4, exchanges heat with the second heating medium through the heat exchanger 5, the temperature of the second heating medium is further increased.

As such, since the second heating medium of the second cycle C2 exchanges heat with the first heating medium through the heat exchanger 5, the first heating medium, having been heated to a high temperature by the compressor 4, transfers high-temperature heat to the second heating medium. Thus, the first heating medium is cooled. Depending on opening or closing of the second valve 7, the second heating medium, having relatively further increased in temperature, may move to a place that needs a high-temperature heat source, or may circulate through the second cycle C2. Here, the place that needs a heat source may be a heating facility of a building, a heating device of a vehicle, etc.

As described above, according to the exemplary form of the present disclosure, the power generator 2 is cooled by the cooling cycle C3, and waste heat generated by cooling the power generator 2 is supplied as a heat source for heating through the first cycle C1. Further, when a heat source for heating is insufficient, the heat source created by the second heating medium, having increased in temperature more than the first heating medium, is supplied through the second cycle C2, by which an insufficient heat source is supplemented and heating is effectively achieved.

The present disclosure will be described below in more detail. As shown in FIG. 1, the first cycle C1 may include an evaporator 3, a compressor 4, a heat exchanger 5, and a first expander 8. The first heating medium, having increased in temperature due to heat exchange with the cooling medium through the evaporator 3, may move to the compressor 4 or to the first supply path C1-A depending on opening or closing of the first valve 6.

In the first cycle C1, which includes the evaporator 3, the compressor 4, the heat exchanger 5, and the first expander 8, the heat exchanger 5 may act as a condenser 10 in the second cycle C2. As such, the first cycle C1 acts as a heat pump cycle. The first heating medium, having increased in temperature due to heat exchange with the cooling medium through the evaporator 3, moves to the first supply path C1-A to supply a heat source when the first valve 6 is opened, or circulates through the compressor 4, the heat exchanger 5 and the first expander 8 to perform a heat pump function when the first valve 6 is closed. Here, the first supply path C1-A may be provided with a separate heat exchanger for supplying a heat source created by the first heating medium and a separate pump for smoothly circulating the first heating medium.

The first expander 8 may be configured as a turbine, which not only acts as an expander but also generates electric energy during the circulation of the first heating medium, thereby improving energy efficiency.

As shown in FIG. 1, the second cycle C2 shares the heat exchanger 5 with the first cycle C1, and includes a second expander 9, a condenser 10, and a heat source pump 11. The second heating medium, having increased in temperature due to heat exchange with the first heating medium through the heat exchanger 5, may move to the second expander 9 or to the second supply path C2-A depending on opening or closing of the second valve 7.

In the second cycle C2, which includes the heat exchanger 5, the second expander 9, the condenser 10, and the heat source pump 11, the heat exchanger 5 may act as an evaporator. As such, the second cycle C2 acts as a heat pump cycle. The second heating medium, having increased in temperature due to heat exchange with the first heating medium through the heat exchanger 5, moves to the second supply path C2-A to supply a heat source when the second valve 7 is opened, or circulates through the second expander 9, the condenser 10 and the heat source pump 11 to perform a heat pump function when the second valve 7 is closed. Here, the second supply path C2-A may be provided with a separate heat exchanger for supplying a heat source created by the second heating medium and a separate pump for efficiently circulating the second heating medium.

The second expander 9 may be configured as a turbine, which not only acts as an expander but also generates electric energy during the circulation of the second heating medium, thereby improving energy efficiency.

The cooling cycle C3 may further include a cooling device 12 for cooling the cooling medium, which is located in the path along which the cooling medium moves from the evaporator 3 to the power generator 2. The cooling device 12 may be configured as a cooling tower, which cools the cooling medium through contact with external air. Any one of various cooling devices other than such a cooling tower may be used to cool the cooling medium.

The cooling device 12, which is located between the evaporator 3 and the power generator 2 in the cooling cycle C3, additionally cools the cooling medium together with the evaporator 3. In order to selectively allow the cooling device 12 to cool the cooling medium, a separate auxiliary valve 15 may be provided in the cooling cycle C3.

In addition, the cooling cycle C3 may be provided with a bypass path 13, along which the cooling medium, moving from the evaporator 3 to the power generator 2, bypasses the cooling device 12, and a bypass valve 14 configured to switch the path along which the cooling medium circulates.

Accordingly, the cooling medium circulating through the cooling cycle C3 is cooled while passing through the cooling device 12. However, if the cooling medium is cooled when the cooling of the cooling medium is unnecessary, the power generator 2 may not be maintained at an appropriate temperature by the over-cooled cooling medium. Therefore, the bypass path 13 for allowing the cooling medium to bypass the cooling device 12 is provided in the cooling cycle C3, and the bypass valve 14 for selectively allowing the cooling medium to move along the bypass path 13 is provided in the bypass path 13. As a result, it is possible to adjust the temperature of the cooling medium to an appropriate level that is desired for the power generator 2.

The operation of the above-described heat pump system according to the present disclosure will be described below.

The controller 100 (see FIG. 7) for controlling the heat pump system may collect various pieces of information including the temperature of external air, demand for a heat source, electricity supply, and the temperature of the power generator, and may control the operation of various pumps and valves in response to the conditions of low-temperature heat supply, high-temperature heat supply, electricity generation and the temperature of the cooling medium that is supplied to the power generator.

Figure 2:
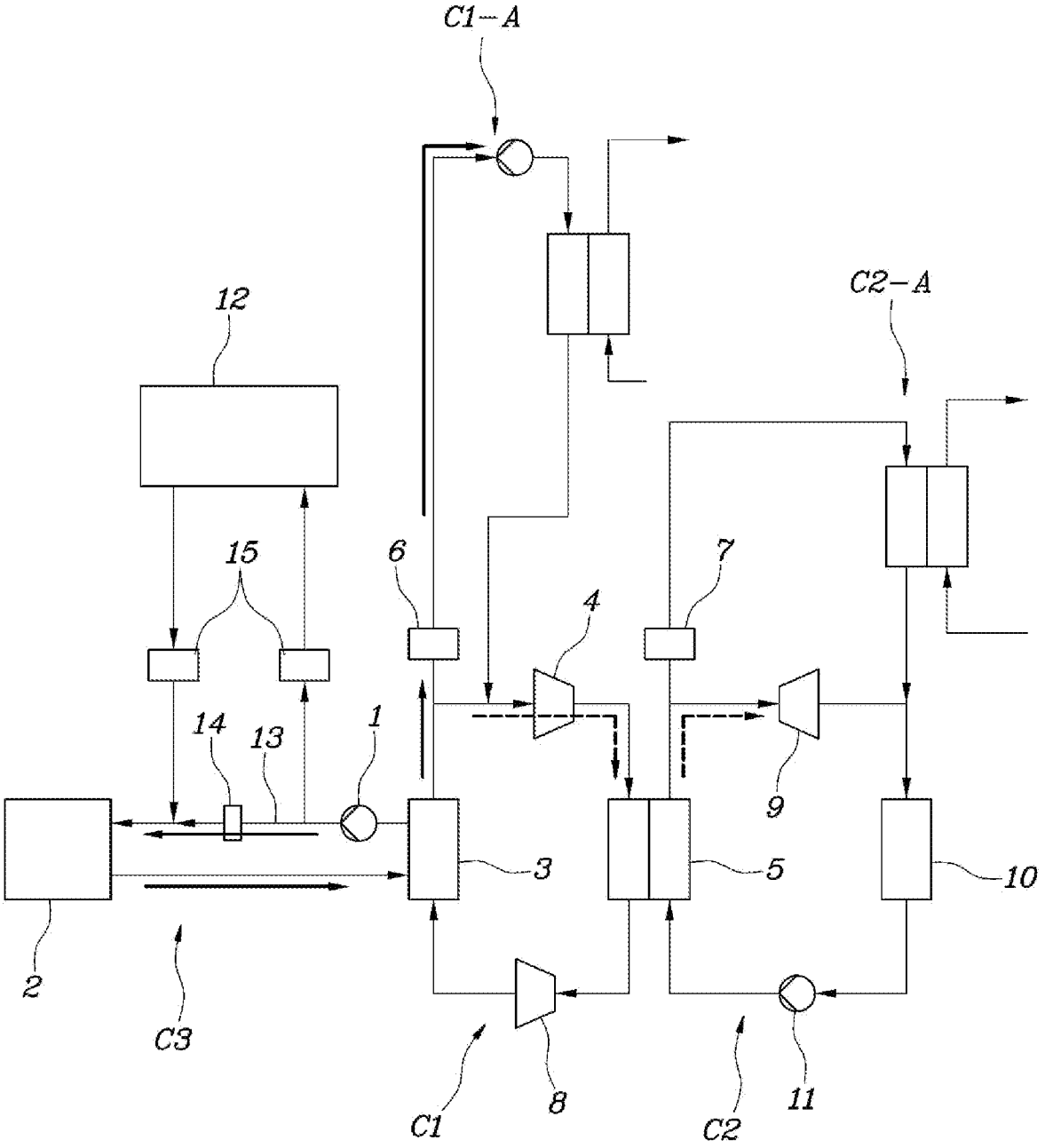
FIGS. 2 through 6 are schematic diagrams showing the operation of the heat pump system shown in FIG. 1.

Referring to FIG. 2, when the power generator 2 is driven, the cooling pump 1 is driven to thus circulate the cooling medium, thereby cooling the power generator 2. At this time, the cooling medium circulating through the cooling cycle C3 is cooled by exchanging heat with the first heating medium of the first cycle C1 through the evaporator 3, and the temperature of the first heating medium is increased.

As shown in FIG. 2, when the supply of a heat source created by the first heating medium is demanded, for example, when heating of a building or a vehicle is demanded, the controller 100 may perform control such that the first valve 6 is opened, the second valve 7 is closed, and the operation degree of the compressor 4 is reduced. The amount of the first heating medium circulating through the first cycle C1 is reduced with the reduction in the operation degree of the compressor 4, and the first heating medium moves to the first supply path C1-A via the opened first valve 6, thereby performing heating using a heat source created by the first heating medium.

Figure 3:
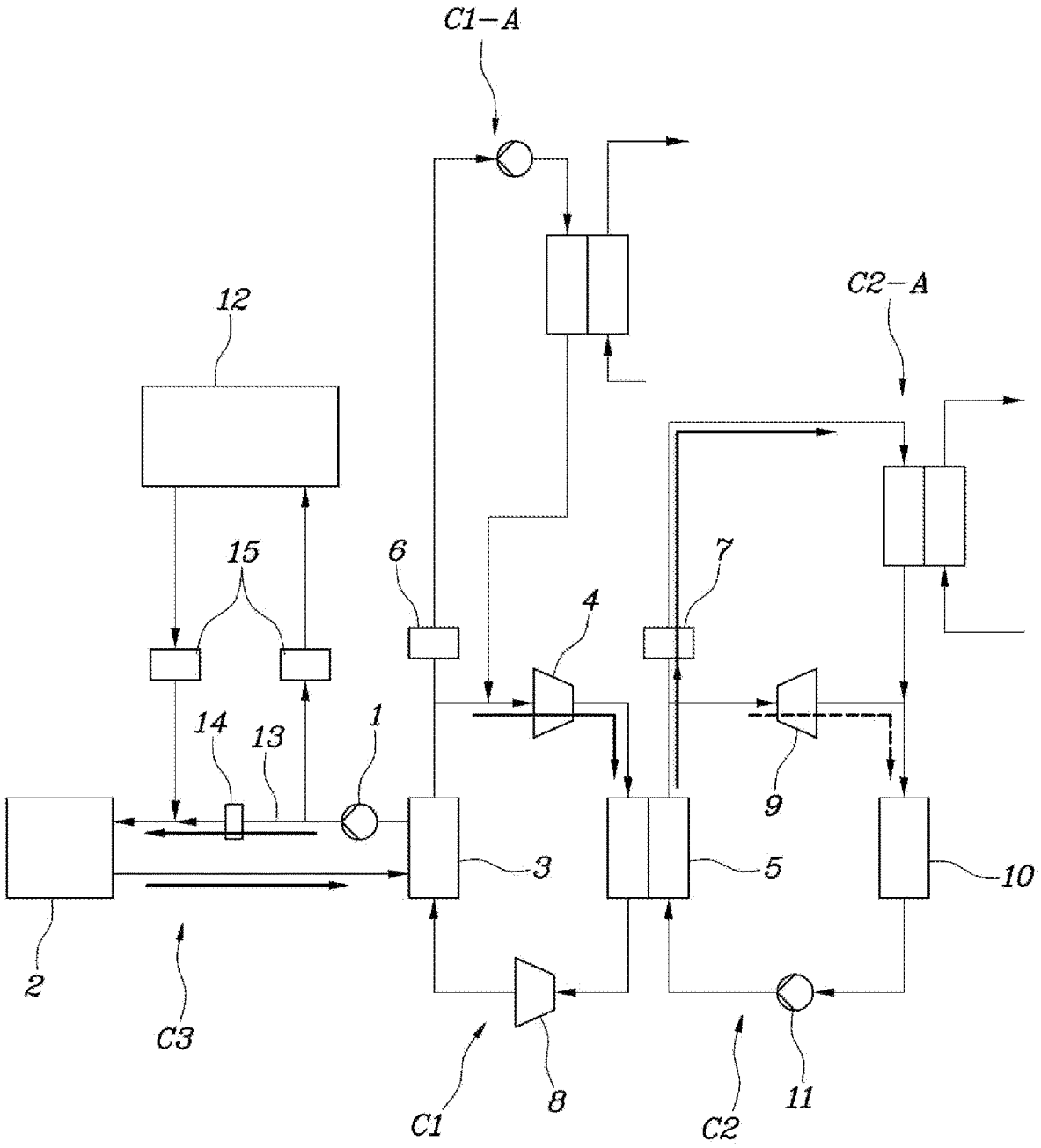

In addition, as shown in FIG. 3, when the supply of a heat source created by the second heating medium is demanded, for example, when district heating is demanded or heating of a building or a vehicle is further demanded, the controller 100 may perform control such that the first valve 6 is closed, the second valve 7 is opened, and the operation degree of the compressor 4 is increased. At this time, the first valve 6 may be closed such that the first heating medium can circulate. The first heating medium passing through the compressor 4 is heated to a high temperature with the increase in the operation degree of the compressor 4. The first heating medium heated to a high temperature by the compressor 4 exchanges heat with the second heating medium through the heat exchanger 5, by which the temperature of the second heating medium is increased to a high level. That is, the second heating medium receives high-temperature heat from the first heating medium by exchanging heat with the first heating medium through the heat exchanger 5, and is thus increased in temperature. The second heating medium, having further increased in temperature in this manner, moves to the second supply path C2-A, thereby performing heating using a heat source created by the second heating medium.

Figure 4:
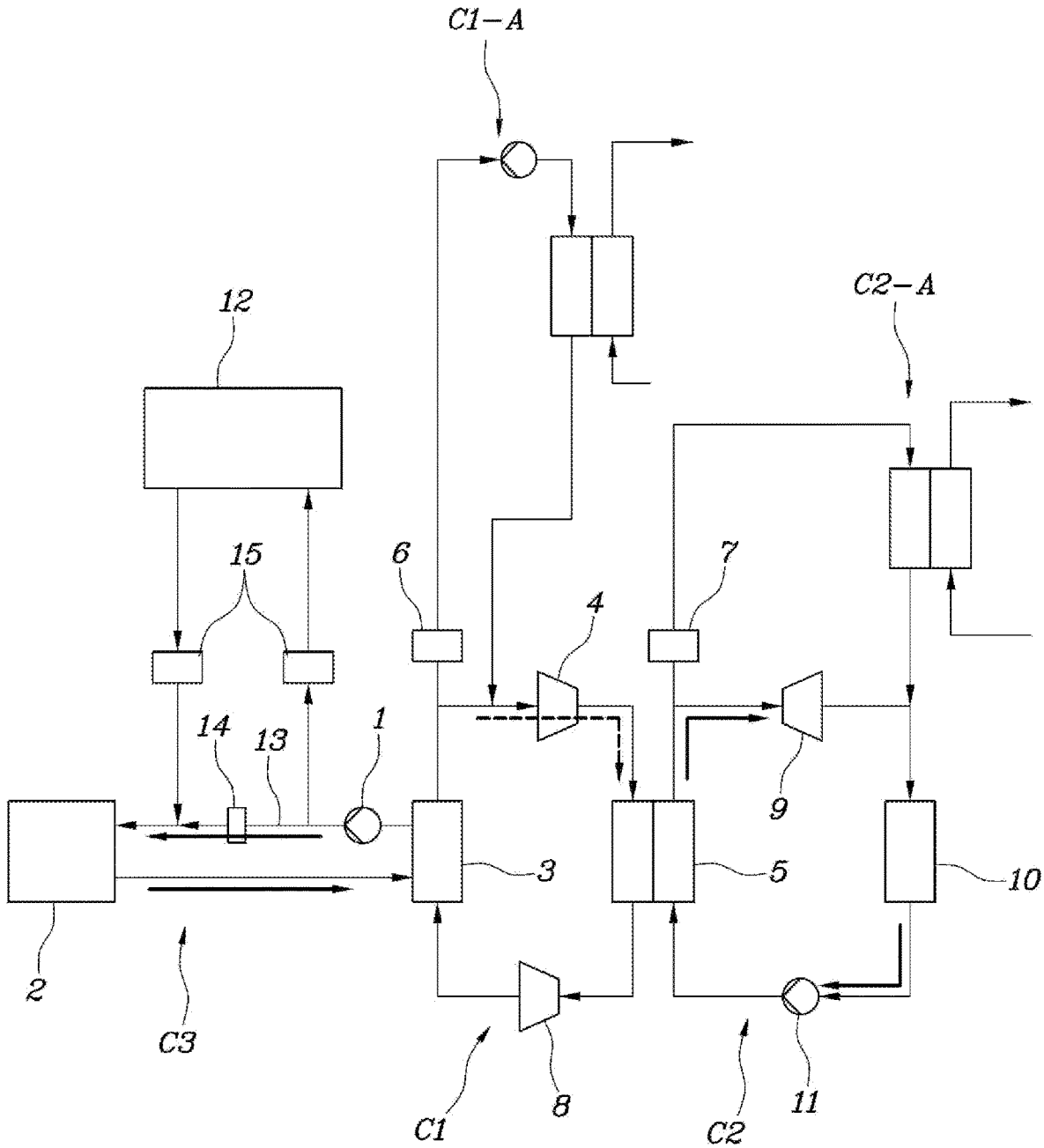

Referring to FIG. 4, when electric energy is insufficient and additional electricity generation is demanded, the controller 100 may perform control such that the second valve 7 is closed and the operation degree of the heat source pump 11 is increased. At this time, the second valve 7 may be closed such that the second heating medium can circulate. The amount of the second heating medium circulating through the second cycle C2 is increased with the increase in the operation degree of the heat source pump 11. Particularly, since the second expander 9 is configured as a turbine in the second cycle C2, electric energy is generated in a low-temperature generation manner during the circulation of the second heating medium.

Figure 5:
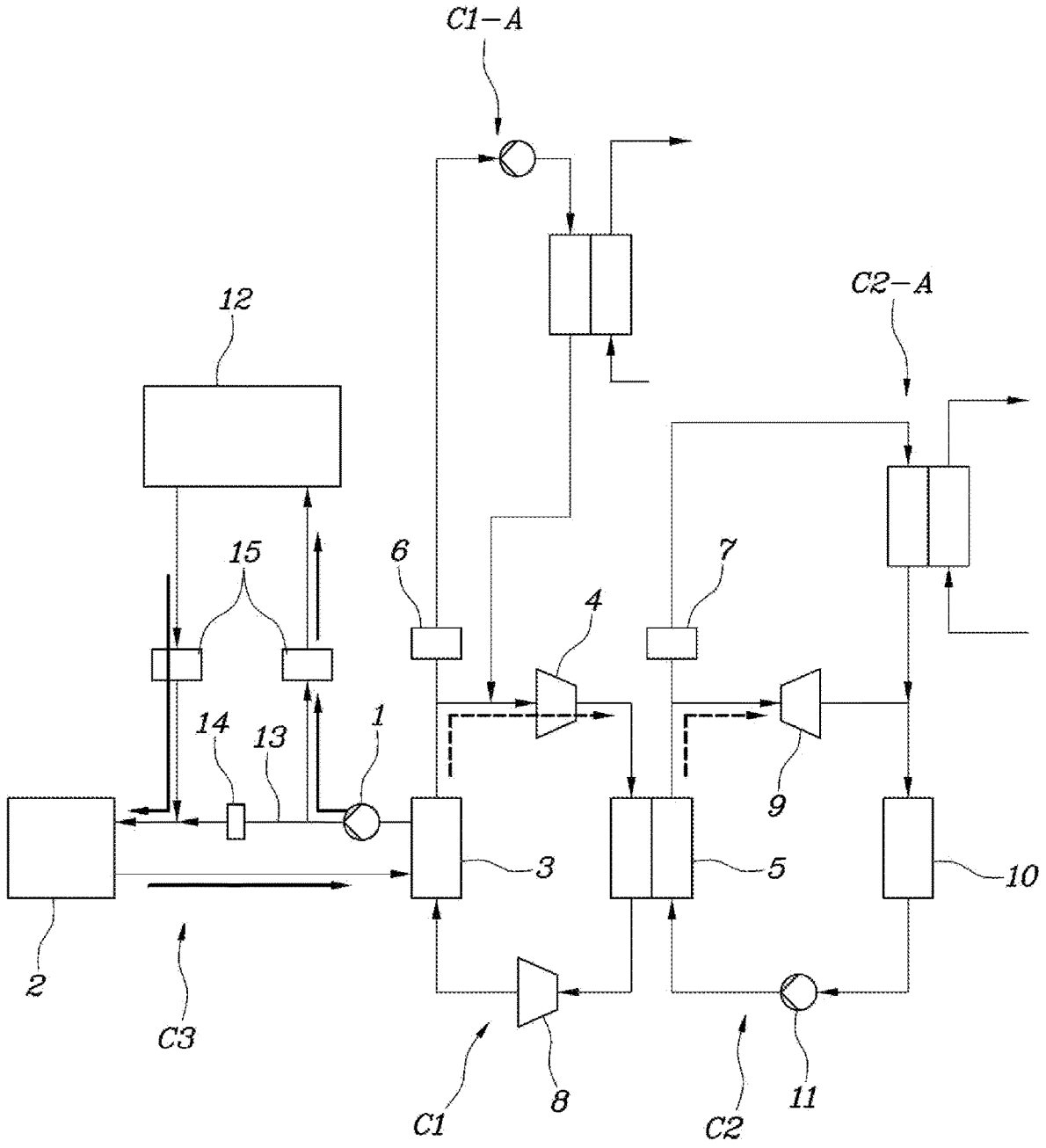

Referring to FIG. 5, when additional cooling of the power generator 2 is demanded, for example, in the hot season, the controller 100 may perform control such that the bypass valve 14 is closed and the operation degree of the cooling pump 1 is increased. The amount of the cooling medium circulating through the cooling cycle C3 is increased with the increase in the operation degree of the cooling pump 1. Thus, the amount of the cooling medium moving to the power generator 2 is increased. Particularly, since the bypass valve 14 is closed, the cooling medium moves to the cooling device 12 and is cooled thereby, and subsequently moves to the power generator 2, whereby the power generator 2 is maintained at an appropriate temperature.

Figure 6:
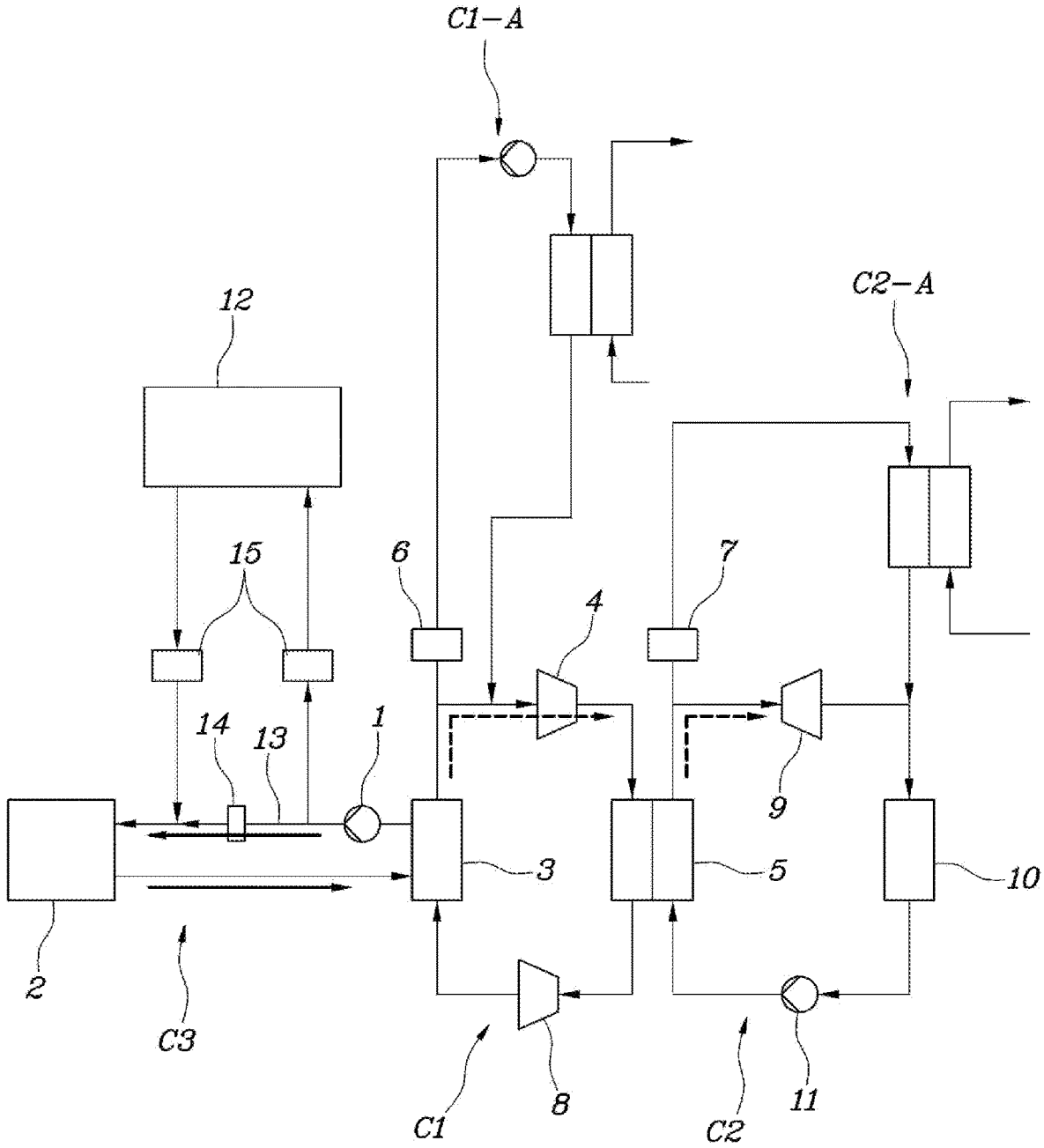
Figure 7:
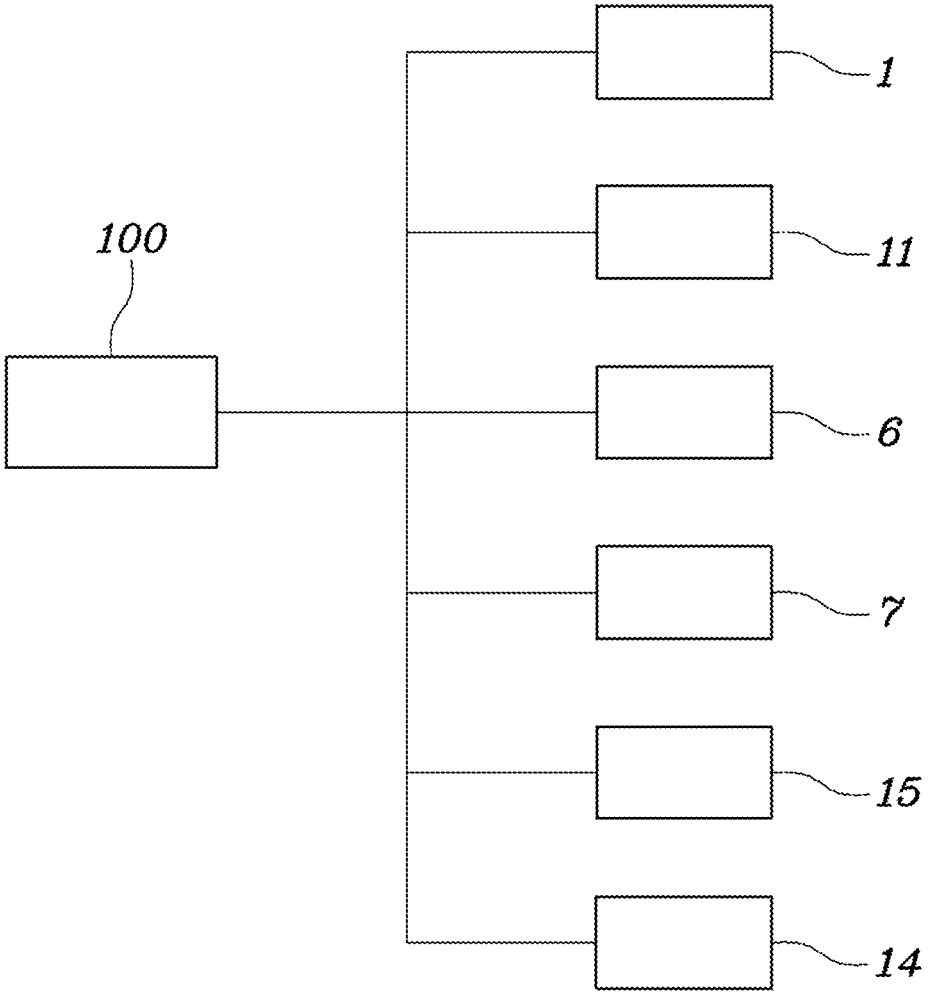
FIG. 7 is a block diagram showing the construction of the heat pump system shown in FIG. 1.

Referring to FIG. 6, when the power generator 2 is likely to be over-cooled, for example, in the cold season, the controller 100 may perform control such that the bypass valve 14 is opened in order to inhibit the cooling medium from moving to the cooling device 12. Here, the controller 100 may determine whether the power generator 2 is in an over-cooled state by collecting information about the temperature of external air, the temperature of the power generator 2, etc. and comparing the collected information with the pre-stored data.

Upon determining that the power generator 2 is in an over-cooled state, the controller 100 may perform control such that the bypass valve 14 is opened, by which the cooling medium moves to the power generator 2 along the bypass path 13 without passing through the cooling device 12. Accordingly, additional cooling of the cooling medium by the cooling device 12 is inhibited, and thus the cooling medium is not over-cooled. As a result, the power generator 2 may be maintained at an appropriate temperature.

As described above, a heat pump system according to the present disclosure removes heat generated during the generation of electric energy using a power generator, and also performs heating using waste heat.

Since an additional heat source is created in order to meet a heating requirement, heating control is effectively achieved, and electric power is produced so as to meet the demand for electric energy.

In addition, when the power generator is likely to be over-cooled in the cold season, cooling of the power generator is stably performed by controlling the temperature and the flow rate of a cooling medium moving to the power generator.

While this present disclosure has been described in connection with what is presently considered to be practical exemplary forms, it is to be understood that the present disclosure is not limited to the disclosed forms, but, on the contrary, it is intended to cover various modifications and equivalent arrangements included within the spirit and scope of the present disclosure.

What is claimed is:

1. A heat pump system comprising:

a cooling cycle configured to circulate a cooling medium therethrough, the cooling cycle including a cooling pump, a power generator, and an evaporator, the power generator and the evaporator being connected to each other so as to perform heat exchange to cause the cooling medium cooled by the evaporator to cool the power generator;

a first cycle configured to circulate a first heating medium therethrough, the first cycle including a compressor, a heat exchanger connected to the evaporator of the cooling cycle so as to perform heat exchange, a first supply path provided between the evaporator and the compressor to supply a heat source created by the first heating medium, and a first valve configured to selectively allow supply of the first heating medium to the first supply path;

a second cycle configured to circulate a second heating medium, exchanging heat with the first heating medium through the heat exchanger, therethrough, the second cycle including a second supply path configured to supply a second heat source created by the second heating medium, having increased in temperature through the heat exchanger, and a second valve configured to selectively allow supply of the second heating medium to the second supply path; and a controller configured to control opening and closing of the first valve and the second valve, wherein, when the controller performs control to open the first valve, the heat source created by the first heating medium is supplied, and when the controller performs control to open the second valve, the second heat source created by the second heating medium is supplied, and wherein, when supply of the heat source created by the first heating medium is demanded, the controller performs control to open the first valve, to close the second valve, and to reduce an operation degree of the compressor.

2. The heat pump system according to claim 1, wherein the first cycle shares the evaporator with the cooling cycle and further includes a first expander, and wherein the first heating medium, having increased in temperature due to heat exchange with the cooling medium through the evaporator, moves to the compressor or to the first supply path depending on opening or closing of the first valve.

3. The heat pump system according to claim 2, wherein the first expander is a turbine configured to generate electric energy during circulation of the first heating medium.

4. The heat pump system according to claim 1, wherein the second cycle shares the heat exchanger with the first cycle and further includes a second expander, a condenser, and a heat source pump, and wherein the second heating medium, having increased in temperature due to heat exchange with the first heating medium through the heat exchanger, moves to the second expander or to the second supply path depending on opening or closing of the second valve.

5. The heat pump system according to claim 4, wherein the second expander is a turbine configured to generate electric energy during circulation of the second heating medium.

6. The heat pump system according to claim 5, wherein, when additional electricity generation is demanded, the controller performs control to close the second valve and to increase an operation degree of the heat source pump.

7. The heat pump system according to claim 1, wherein the cooling cycle further includes a cooling device configured to cool the cooling medium, and the cooling device is located in a path along which the cooling medium moves from the evaporator to the power generator.

8. The heat pump system according to claim 7, wherein the cooling cycle further includes a bypass path along which the cooling medium, moving from the evaporator to the power generator, bypasses the cooling device, and a bypass valve configured to selectively switch the path along which the cooling medium moves from the evaporator to the power generator.

9. The heat pump system according to claim 8, wherein, when additional cooling of the power generator is demanded, the controller performs control to close the bypass valve and to increase an operation degree of the cooling pump.

10. The heat pump system according to claim 8, wherein the controller determines whether the power generator is in an over-cooled state, and wherein, upon determining that the power generator is in the over-cooled state, the controller controls the bypass valve to be opened to inhibit the cooling medium from moving to the cooling device.

11. A heat pump system comprising:

a cooling cycle configured to circulate a cooling medium therethrough, the cooling cycle including a cooling pump, a power generator, and an evaporator, the power generator and the evaporator being connected to each other so as to perform heat exchange to cause the cooling medium cooled by the evaporator to cool the power generator;

a first cycle configured to circulate a first heating medium therethrough, the first cycle including a compressor, a heat exchanger connected to the evaporator of the cooling cycle so as to perform heat exchange, a first supply path provided between the evaporator and the compressor to supply a heat source created by the first heating medium, and a first valve configured to selectively allow supply of the first heating medium to the first supply path;

a second cycle configured to circulate a second heating medium, exchanging heat with the first heating medium through the heat exchanger, therethrough, the second cycle including a second supply path configured to supply a second heat source created by the second heating medium, having increased in temperature through the heat exchanger, and a second valve configured to selectively allow supply of the second heating medium to the second supply path; and a controller configured to control opening and closing of the first valve and the second valve, wherein, when the controller performs control to open the first valve, the heat source created by the first heating medium is supplied, and when the controller performs control to open the second valve, the second heat source created by the second heating medium is supplied, and wherein, when supply of the heat source created by the second heating medium is demanded, the controller performs control to close the first valve, to open the second valve, and to increase an operation degree of the compressor.

* * * * *